US010407998B1

(12) United States Patent
Raymond et al.

(10) Patent No.: US 10,407,998 B1
(45) Date of Patent: Sep. 10, 2019

(54) VARIABLE RATE COMPLIANCE MODULES, ASSEMBLIES AND TOOLS FOR SUPPRESSION OF DRILLING VIBRATIONS

(71) Applicants: National Technology & Engineering Solutions of Sandia, LLC, Albuquerque, NM (US); William T. Radigan, Albuquerque, NM (US)

(72) Inventors: David W. Raymond, Edgewood, NM (US); Stephen Buerger, Albuquerque, NM (US); Avery Ted Cashion, IV, Albuquerque, NM (US); Mikhail Mesh, Albuquerque, NM (US); William T. Radigan, Albuquerque, NM (US); Jiann-Cherng Su, Albuquerque, NM (US); Elton K. Wright, Rio Rancho, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 211 days.

(21) Appl. No.: 15/267,839

(22) Filed: Sep. 16, 2016

Related U.S. Application Data

(60) Provisional application No. 62/219,481, filed on Sep. 16, 2015.

(51) Int. Cl.
*E21B 7/06* (2006.01)
*E21B 17/07* (2006.01)
*E21B 47/00* (2012.01)

(52) U.S. Cl.
CPC ..... *E21B 17/07* (2013.01); *E21B 47/00* (2013.01)

(58) Field of Classification Search
CPC ..... E21B 17/07; E21B 17/028; E21B 17/24; E21B 47/011
USPC ..... 175/257, 262, 320–325; 166/66.5, 66.6, 166/242.7; 267/125, 136, 137; 188/378
See application file for complete search history.

(56) References Cited

U.S. PATENT DOCUMENTS 5,316,259 A * 5/1994 Pawlykowych ..... B62J 1/06 248/601
2005/0258582 A1* 11/2005 Chou ..... F16F 1/041 267/177
2014/0001684 A1* 1/2014 Miyata ..... B62J 1/04 267/132

(Continued)

*Primary Examiner* — Christopher P Schwartz
(74) *Attorney, Agent, or Firm* — Daniel J. Jenkins

(57) ABSTRACT

A suppression module, a suppression assembly, and a drilling tool are disclosed. The suppression module includes a spindle having a first end and a second end, an ear plate slideably disposed between the first end and the second end, a spring positioned between the ear plate and the first end, and an activation mechanism coaxially disposed around the second end of the spindle. The activation mechanism engages the ear plate, activating the spring, or disengages the ear plate, deactivating the spring. The suppression assembly includes at least two suppression modules in series coupled to a processor. The suppression modules are activated or deactivated by the processor, each of the suppression modules being activated or deactivated independent of the other suppression modules. The drilling tool includes a drill pipe, a drill bit, a vibration sensor, and a suppression assembly between the drill pipe and the drill bit.

16 Claims, 6 Drawing Sheets

(56) References Cited

U.S. PATENT DOCUMENTS

| | | | | |
|---|---|---|---|---|
| 2014/0151122 | A1* | 6/2014 | Venugopal | E21B 47/011 175/40 |
| 2015/0000892 | A1* | 1/2015 | Hradecky | E21B 47/12 166/65.1 |
| 2015/0041219 | A1* | 2/2015 | LeBlanc | E21B 4/003 175/92 |
| 2017/0234073 | A1* | 8/2017 | Nguyen | E21B 47/00 175/40 |
| 2018/0023347 | A1* | 1/2018 | Bleeker | E21B 3/00 175/57 |

* cited by examiner

VARIABLE RATE COMPLIANCE MODULES, ASSEMBLIES AND TOOLS FOR SUPPRESSION OF DRILLING VIBRATIONS

CROSS-REFERENCE TO RELATED APPLICATIONS

This application claims priority to provisional patent applications U.S. Ser. No. 62/219,481, entitled "Drilling System Vibration Suppression Systems and Methods," by Raymond et al., filed Sep. 16, 2015, the disclosure of which is incorporated herein by reference in its entirety.

STATEMENT CONCERNING FEDERALLY-SPONSORED RESEARCH

This invention was developed under Contract DE-AC04-94AL85000 between Sandia Corporation and the United States Department of Energy. The U.S. Government has certain rights in this invention.

FIELD OF THE INVENTION

The present invention is directed to a suppression module, a suppression assembly, and a drilling tool. More particularly, the present invention is directed to fixed rate suppression modules, a variable rate suppression assembly formed from the fixed rate suppression modules, and a drilling tool including the variable rate suppression assembly.

BACKGROUND OF THE INVENTION

Commercial drilling applications, such as rock drilling for oil and gas typically use elongated drillstrings having a drill bit attached thereto. During drilling the drillstrings often experience vibrations, such as self-excited vibrations (chatter) in the longitudinal direction (axial chatter), rotational vibration and bit whirl. The vibrations in the bit of a drillstring may produce an undulated surface in the rock and/or cause failure of the cutter portion. In particular, failures of Polycrystalline Diamond Compact ("PDC") cutters and damage to the bottom hole assembly are of concern.

Even though there are many types of vibrations encountered during drilling, chatter is considered to be one of the main causes of failure in PDC bits, particularly in hard rock formations such as Sierra White Granite ("SWG"). When the PDC bits fail a new bit must be installed, requiring removal of the drillstring from the drilling hole. Removing the drillstring halts drilling, which increases operational cost and repair time.

It has been shown that the proper combination of weight on bit ("WOB"), rotating speed, and bit design reduces the axial chatter. However, the bit design is not adjustable or variable under field conditions and poor surface telemetry with bottom hole conditions often results in the actual downhole dynamic conditions being incorrectly diagnosed. This is particularly important as the dynamics of drillstrings are constantly varying with the drilling depth. Moreover, rock properties vary and unexpected variations in rock hardness is common. Sudden changes in load as the bit transitions a soft-to-hard rock boundary is often sufficient to induce drillstring instability.

A suppression assembly and drilling tool for suppressing drilling vibrations that do not suffer from one or more of the above drawbacks would be desirable in the art.

BRIEF DESCRIPTION OF THE INVENTION

In an embodiment, a suppression module includes a spindle having a first end and a second end, an ear plate slideably disposed between the first end and the second end, a spring positioned between the ear plate and the first end, and an activation mechanism coaxially disposed around the second end of the spindle. The activation mechanism engages the ear plate, activating the spring, or disengages the ear plate, deactivating the spring.

In another embodiment, a suppression assembly includes at least two suppression modules, each suppression module comprising a spindle having a first end and a second end, an ear plate slideably disposed between the first end and the second end, a spring positioned between the ear plate and the first end, and an activation mechanism coaxially disposed around the second end of the spindle; and a processor. The activation mechanism engages the ear plate, activating the spring, or disengages the ear plate, deactivating the spring. The suppression modules are activated or deactivated by the processor, each of the suppression modules being activated or deactivated independent of the other suppression modules.

In another embodiment, a drilling tool includes a drill pipe, a drill bit, a variable stiffness suppression assembly between the drill pipe and the drill bit, the variable stiffness suppression assembly including at least two suppression modules, each of the suppression modules having a prescribed stiffness, a processor coupled to the variable stiffness suppression assembly, and a vibration sensor coupled to the processor, the vibration sensor arranged and disposed to determine vibration in the drilling tool. The suppression modules are activated or deactivated by the processor, each of the suppression modules being activated or deactivated independent of the other suppression modules to vary the stiffness of the suppression module in response to the vibration in the drilling tool.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are a suppression module, a suppression assembly, and a drilling tool. Embodiments of the present disclosure, in comparison to similar tools and methods that fail to include one or more of the features of the present disclosure, for example, decrease drillstring vibration, increase drilling efficiency, increase drilling rate, decrease drill bit wear, permit remote activation and deactivation of suppression modules, permit remote variation of a suppression assembly stiffness, or a combination thereof.

Figure 1:
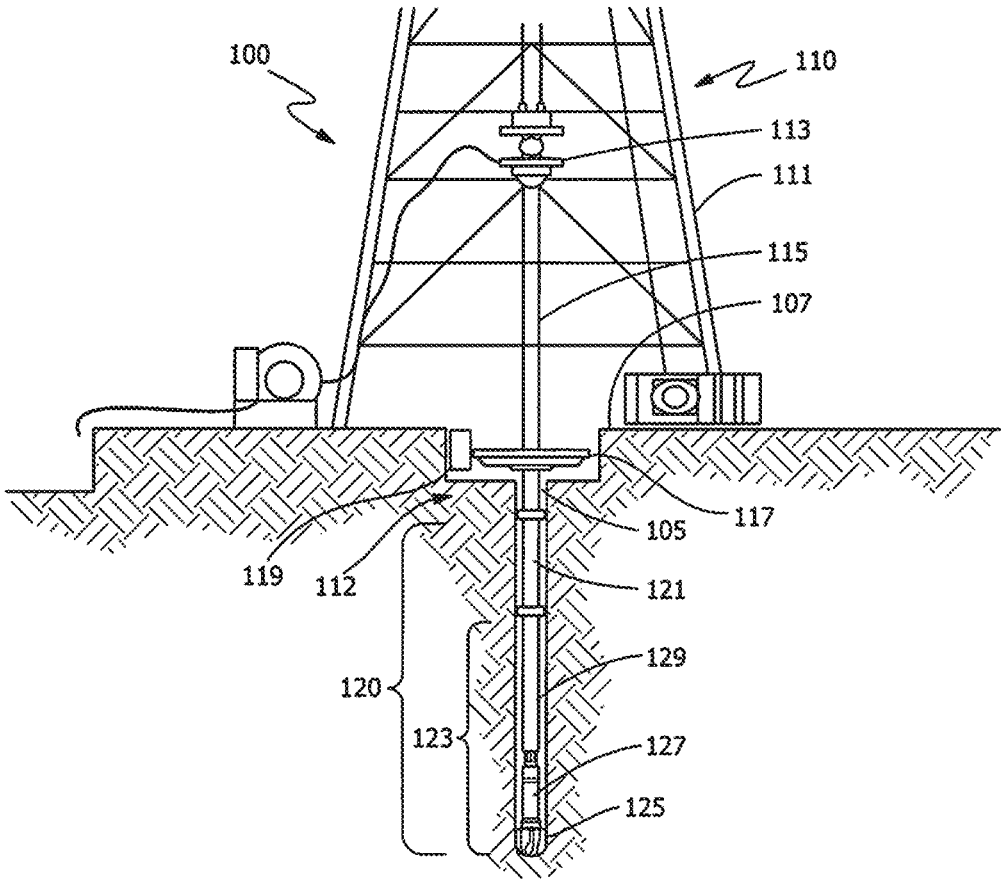
FIG. 1 is a schematic view of a drilling assembly.

FIG. 1 illustrates an embodiment of a drilling assembly 100 according to the present disclosure. As can be seen in FIG. 1, the drilling assembly 100 includes a support assembly 110 and a drilling tool 112 suspended from the support assembly 110. The support assembly 100 includes a derrick 111, a swivel 113, a kelly drive 115, and a rotary table 117. In another embodiment, the support assembly 110 may include other derrick, swivel, drive and rotary table configurations as would be appreciated by one of ordinary skill in the art. In an embodiment, the drilling assembly 100 may be used for deep wellbore drilling.

The drilling tool 112 includes a drillstring 120 having a drill pipe 121 and a bottom hole assembly 123 coupled to the drill pipe 121. The bottom hole assembly 123 includes a drill bit 125 coupled to a drill collar 127 coupled to a shock assembly 129 coupled to the drill pipe 121. In another embodiment, the bottom hole assembly 123 may include one or more subassemblies 129. The drill collar 127 provides weight to the drill bit 125. The drillstring 120 is rotated by the rotary table 117, which is rotated by any suitable mechanism, such as, but not limited to, a motor 119. The rotation of the drillstring 120 rotates the drill bit 125, drilling a bore hole 105 extending from a surface 107.

Figure 2:
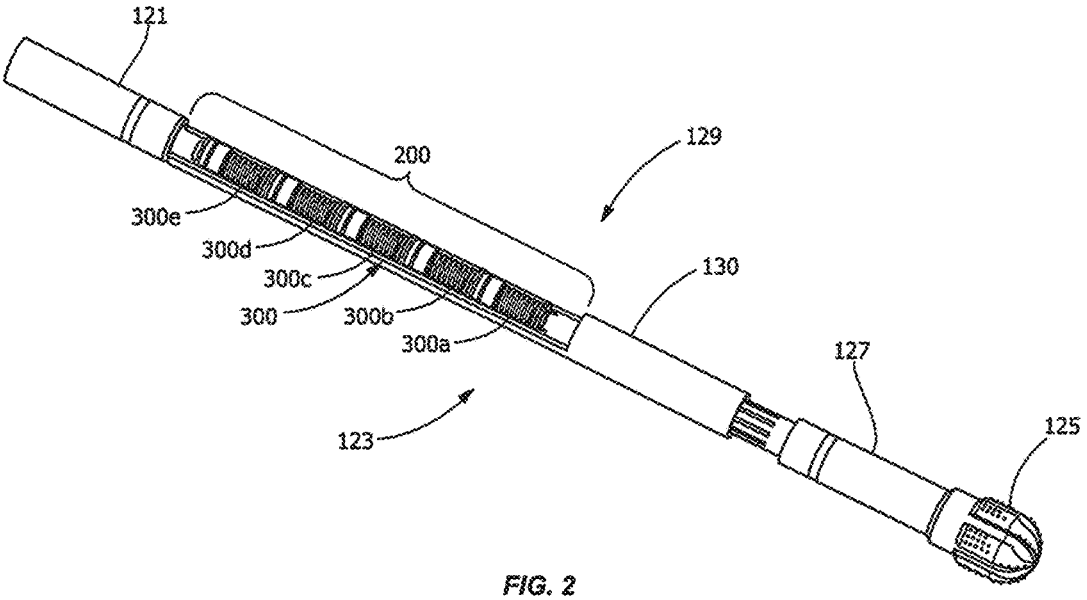
FIG. 2 is a cut away view of a drillstring, according to an embodiment of the disclosure.

FIG. 2 illustrates an embodiment of the shock assembly 129 according to the present invention. The shock assembly 129 includes a housing 130 and suppression modules (modules) 300. A portion of the housing 130 has been removed so the modules 300 may be viewed. In this exemplary embodiment, the shock assembly 129 includes five modules 300, labeled 300*a* through 300*e*, with the module 300*a* being referred to as the first module. In another embodiment, the shock assembly 129 may include one or more modules 300. Although there is no upper limit on the number of modules 300 that may be included in the shock assembly 129, the number of modules 300 in the shock assembly 129 may be limited by a length of the shock assembly 129. For example, a thirty foot shock assembly 129 may include between two and six modules 300, whereas a fifteen foot shock assembly 129 may include between two and three modules 300. As will be appreciated by one skilled in the art, the number of modules 300 in the shock assembly 129 will vary based upon the size of the suppression modules 300, and is not limited to the examples provided above.

As the drilling tool 112 advances in the bore hole 105, each of the modules 300 may be independently activated or deactivated to increase or decrease the overall stiffness of the shock assembly 129, respectively. The activation and deactivation of a module is discussed below. The individual modules 300 provide a variable stiffness to the shock assembly 129, which reduces transmissibility of longitudinal vibrations into the drillstring 120. In one embodiment, the variable stiffness of the shock assembly 129 absorbs and decreases or eliminates vibration during drilling to stabilize the drilling tool 112 at near-zero vibration levels. Additionally, the variable stiffness increases stability of the drillstring 120 by changing the dynamic compliance of the drillstring 120 supporting the drill bit 125. For example, the modules 300 may be activated or deactivated in response to contact with surfaces having different hardness values.

Figure 3:
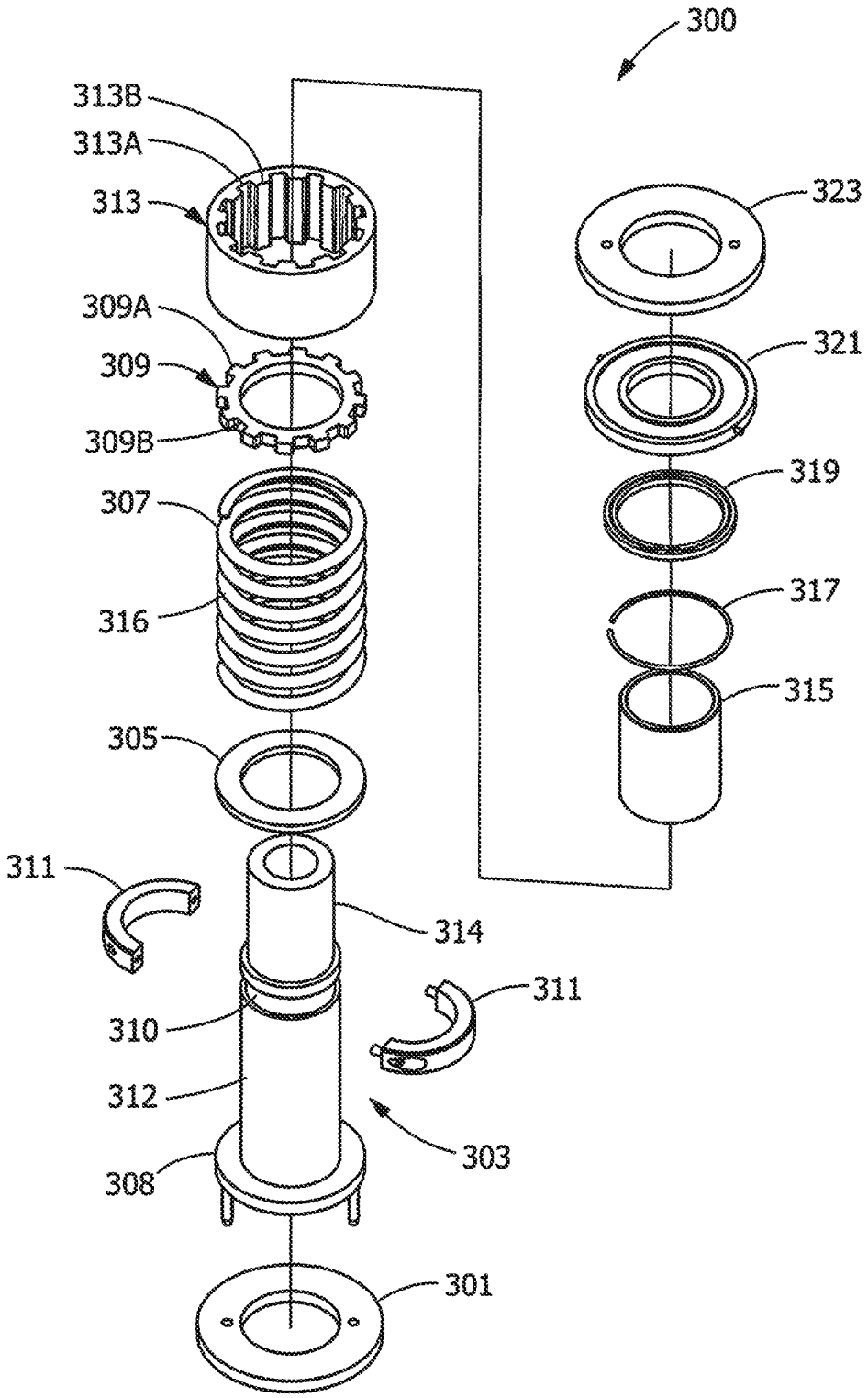
FIG. 3 is an exploded view of a suppression module, according to an embodiment of the disclosure.

FIGS. 3-5 illustrate an embodiment of a module 300 according to the present disclosure. As can be seen in FIGS. 3-5, module 300 includes a bottom plate 301, a top plate 323, and a side portion 302 (see FIGS. 4-5, omitted from FIG. 3 for clarity) extending between the bottom plate 301 and the top plate 323. In this exemplary embodiment, the bottom and top plates 301, 323 are fitted to the side portion 302. In another embodiment, the bottom and top plates 301, 323 are secured to opposite ends of the side portion 302 to form an enclosure. In a further embodiment, the enclosure formed by the bottom plate 301, the top plate 323, and the side portion 302 includes any suitable geometry for being positioned within the drill pipe 121 and/or secured to the drillstring 120. For example as seen in this embodiment, in one suitable enclosure, the top plate 323 and the bottom plate 301 are circular or substantially circular, and the side portion 302 includes a cylinder extending between the top plate 323 and the bottom plate 301.

A spindle 303 is movably positioned at least partially within the enclosure. The spindle 303 includes a base portion 308 and an elongated portion 312. The elongated portion 312 extends away from the base portion 308, terminating in a distal end 314. The distal end 314 is configured to slide through an aperture in the top plate 323 when the spindle 303 is moved axially between the top plate 323 and the bottom plate 301. In this exemplary embodiment, the spindle 303 includes posts 304 secured to the base portion 308. The posts 304 are configured to extend through corresponding apertures in the bottom plate 301, aligning the spindle 303 and reducing or eliminating rotation of the spindle 303 with respect to the bottom plate 301. Additionally, the posts 304 extend through corresponding apertures in the top plate 323 of any suppression module 300 positioned adjacent to bottom plate 301. The posts 304 reduce or eliminate rotation of the suppression modules 300 with respect to each other. In another embodiment, the posts 304 may be attached to another component. In this exemplary embodiment, the spindle 303 is fitted within the side portion 302. In another embodiment, the spindle 303 is keyed to a shaft and/or the side portion 302 is keyed to the suppression assembly 200 to reduce or eliminate rotation of the spindle 303 within the suppression module 300 and/or rotation of the suppression module 300 within the suppression assembly 200, respectively.

As illustrated in FIG. 3, the spindle 303 includes a channel 310 extending at least partially around the elongated portion 312, the channel 310 being formed at a location between the distal end 314 and the base portion 308. A retaining member 311 is secured within the channel 310. The retaining member 311 includes any suitable shape corresponding to the spindle 303. Suitable shapes include, but are not limited to, annular, square, oval, helical thread, any other geometric shape, or a combination thereof. For example, the retaining ring 311 may be annular, and include two or more sections which are attached to secure the retaining ring 311 around the spindle 303. The two or more sections of the retaining ring 311 may be attached by threaded members, pins, clips, or any other suitable attachment mechanism. In another embodiment, the spindle may 303 may include other retainers, fasteners, grooves, channels to position the spindle components within the module.

Figure 6:
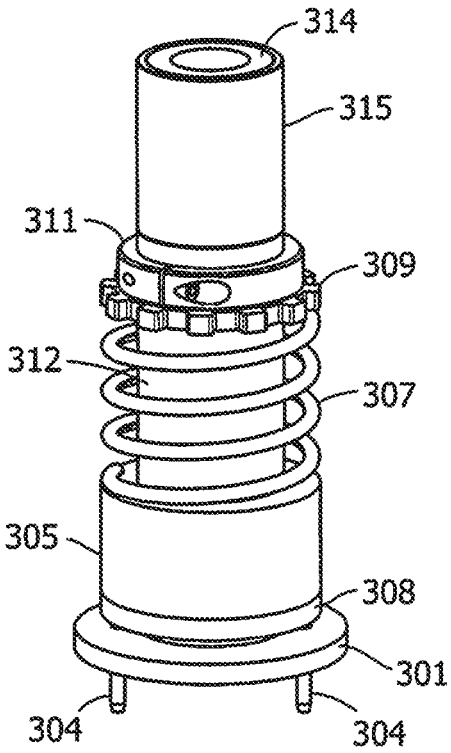
FIG. 6 is an isolation view of a spindle having a helical spring and a larger spacer, according to an embodiment of the disclosure.
Figure 7:
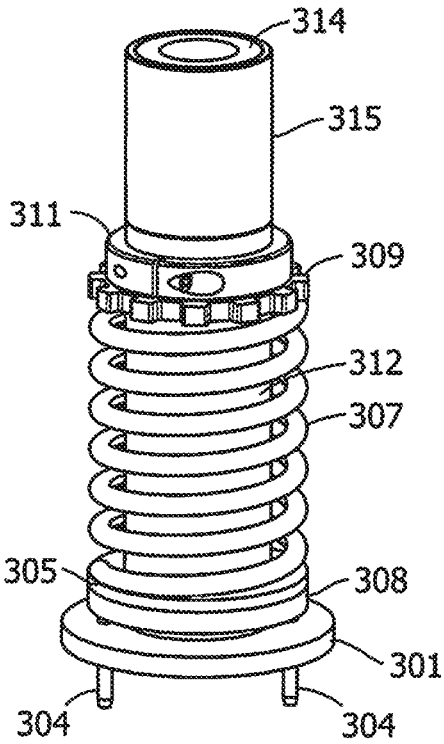
FIG. 7 is an isolation view of a spindle having a helical spring and a smaller spacer, according to an embodiment of the disclosure.
Figure 8:
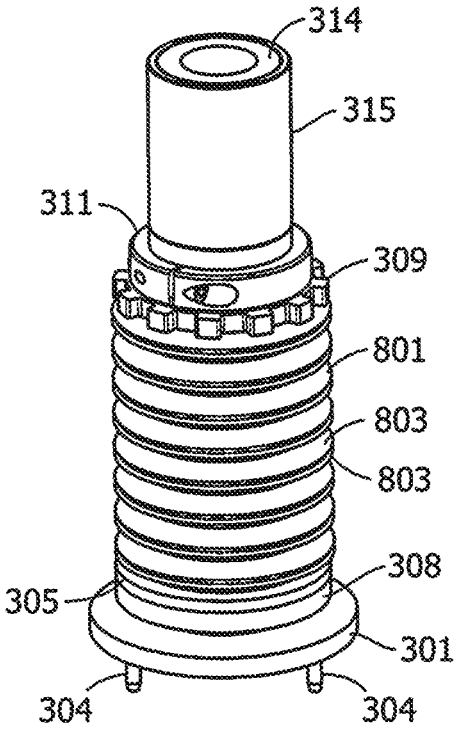
FIG. 8 is an isolation view of a spindle having a Belleville spring, according to an embodiment of the disclosure.

The retaining ring 311 is axially fixed on the spindle 303, and provides a stop for an ear plate 309 movably positioned between the retaining ring 311 and the base portion 308. The ear plate 309 may be keyed to the spindle 303, such as, for example, with a projection and mating recess, to reduce or eliminate rotation of the ear plate 309 with respect to the spindle 303. Any suitable spring 307 or other force providing member is positioned between the ear plate 309 and the base portion 308. For example, in one embodiment, as illustrated in FIGS. 2-7, the spring 307 includes a helical spring 316. In another embodiment, as illustrated in FIG. 8, the spring 307 includes a Belleville spring 801. The Belleville spring 801 comprises one or more frusto-conical shaped washers 803 which provide a spring characteristic when force is applied. Other force providing members include, but are not limited to, liquid springs, elastomers, neo-Hookean solids, other Hookean materials, or a combination thereof.

Both the ear plate 309 and the spring 307 may be coaxially positioned around the elongated member 312. The spring 307 extends towards distal end 314, positioning the ear plate 309 adjacent to, and/or in contact with, the retaining ring 311. The ear plate 309 is configured to engage the spring 307, such that when the ear plate 309 is engaged, as discussed in detail below, the ear plate 309 compresses the spring against the base portion 308. In one embodiment, the suppression module 300 includes a spacer 305 positioned between the spring 307 and the base portion 308. In another embodiment, the spacer 305 decreases the length between the ear plate 309 and the base plate 308. As best illustrated in FIGS. 6-7, decreasing the length between the ear plate 309 and the base plate 308 provides an interchangeability between springs 307 having varying lengths (e.g., larger spacers 305 for shorter springs 307). In a further embodiment, increasing a size of the spacer 305 modifies a stiffness of the suppression module 300 by partially compressing the spring 307 into a specified range (i.e., for a non-linear spring).

An activation mechanism 313 is positioned within the enclosure, the activation mechanism 313 including any suitable mechanism for engaging or disengaging the ear plate 309 as the spindle 303 moves between the top plate 323 and the bottom plate 301. Suitable mechanisms include, but are not limited to, an engagement spline, a mechanical lock, or a combination thereof. An axial opening in the activation mechanism 313 permits the elongated portion 312 of the spindle 303 to pass therethrough. In one embodiment, the activation mechanism 313 is directly or indirectly coupled to the top plate 323. In another embodiment, the activation mechanism 313 is movable with respect to the enclosure, the spindle 303, and/or the ear plate 309. For example, as illustrated in FIGS. 3-5, the activation mechanism 313 may be rotatably coupled to a latch mechanism 321, which is secured to the top plate 323.

Additionally, each of the suppression modules 300 includes an actuator 317. The actuator 317 includes any suitable actuator for moving and/or rotating the activation mechanism 313 between an active configuration (shown in FIGS. 4A and 4B) and an inactive configuration (shown in FIGS. 5A and 5B). Suitable actuators include, but are not limited to, a mechanical actuator, a thermal actuator, an electrical actuator, a remote actuator, or a combination thereof. For example, in one embodiment, the actuator 317 includes a shape memory alloy (SMA) configured to rotate the activation mechanism 313 into the active position when heated. In another embodiment, a bias spring (not shown) opposes a force of the SMA, such that when the SMA is cooled the bias spring returns the activation mechanism 313 to the inactive position. In a further embodiment, a bearing 319 may be positioned between the latch mechanism 321 or the top plate 323 and the activation mechanism 313, the bearing 319 reducing or eliminating friction as the activation mechanism 313 is moved between the active and inactive positions.

Figure 4A:
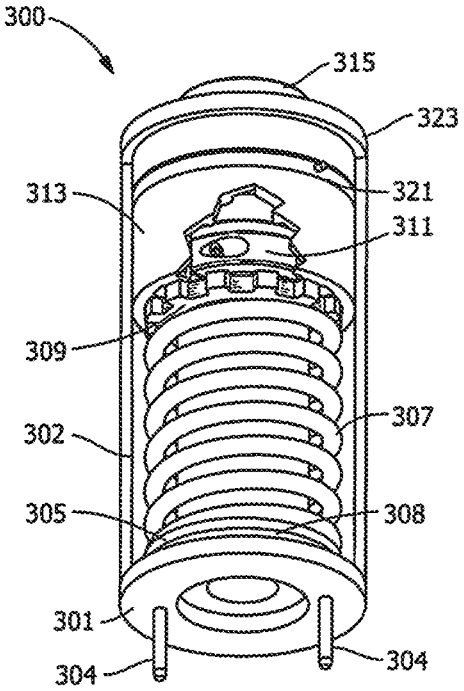
FIG. 4A is a perspective view of a suppression module in an active, base configuration in a base position, according to an embodiment of the disclosure.
Figure 4B:
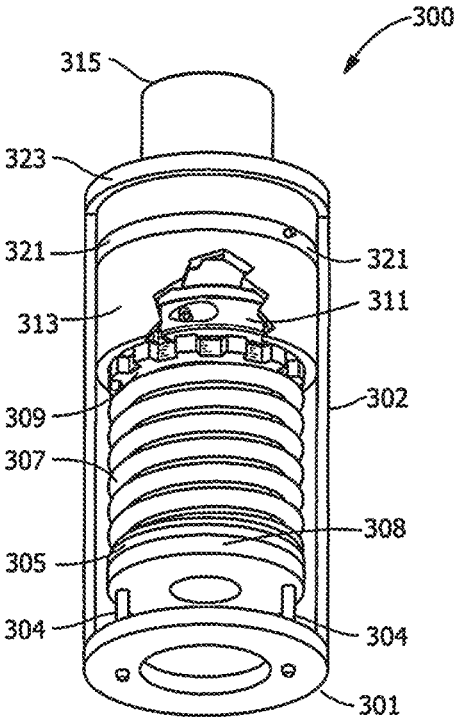
FIG. 4B is a perspective view of the suppression module in the active, extended configuration in an extended position.

FIGS. 4A and 4B show a suppression module 300 in an active configuration. In the active configuration, the projections 313B (see FIG. 3 for better clarity) within the activation mechanism 313 align with the corresponding projections 309A on the ear plate 309. The aligned projections 313B within the activation mechanism 313 engage the corresponding projections 309A on the ear plate 309, restricting movement of the ear plate 309 through the activation mechanism 313. When the spindle 303 subsequently moves away from the bottom plate 301, the elongated portion 312 slides through the activation mechanism 313 and the engaged ear plate 309, compressing the spring 307 between the ear plate 309 and the base portion 308.

In FIG. 4A, the suppression module 300 is shown in an active configuration in a base position before force is applied to the bottom plate 308. In FIG. 4B the suppression module 300 is shown in an active configuration in an extended position after force is applied to the bottom plate 308.

Figure 5A:
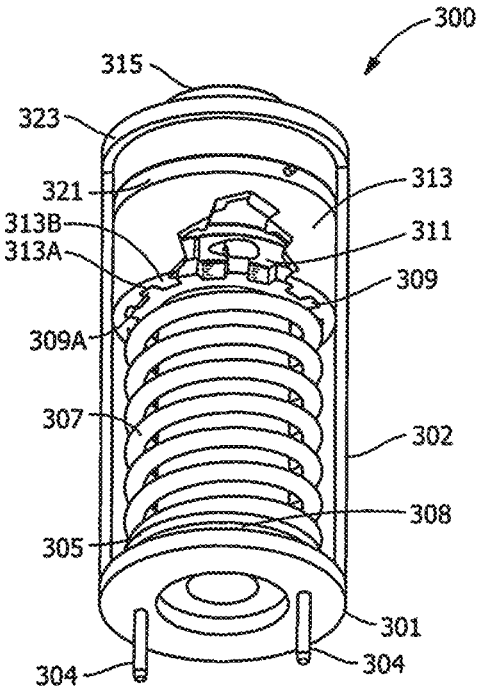
FIG. 5A is a perspective view of a suppression module in an inactive configuration in an inactive, base position, according to an embodiment of the disclosure.
Figure 5B:
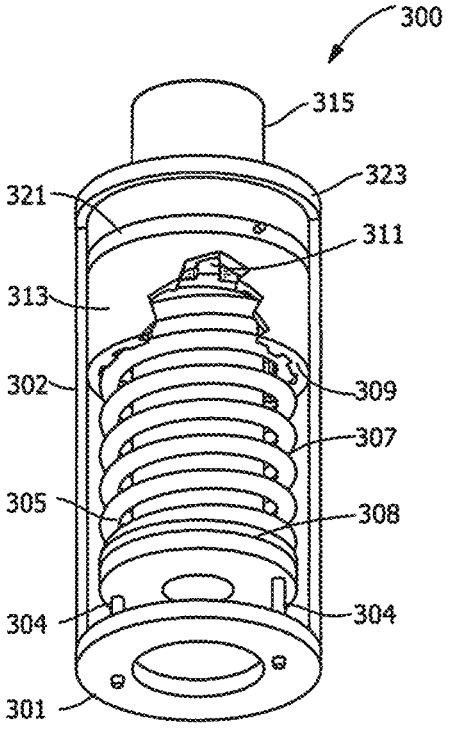
FIG. 5B is a perspective view of the suppression module in an inactive configuration in an inactive, extended position according to an embodiment of the disclosure.

FIGS. 5A and 5B show a suppression module 300 in an inactive configuration. In the inactive configuration, projections 313B (see FIG. 3 for additional clarity) within the activation mechanism 313 align with corresponding recesses 309B on the ear plate 309, and recesses 313A within the activation mechanism 313 align with corresponding projections 309A on the ear plate 309. The aligned projections and recesses permit the ear plate 309 to pass through the activation mechanism 313, such that when the spindle 303 moves away from the bottom plate 301 both the elongated portion 312 and the ear plate 309 slide through the activation mechanism 313 without compressing the spring 307.

In FIG. 5A, the suppression module 300 is shown in an inactive configuration in an inactive configuration and in a base position before force is applied to the bottom plate 308. In FIG. 5B, the suppression module 300 is shown in an inactive configuration in an extended position after force is applied to the bottom plate 308.

Selectively activating and deactivating the suppression modules comprising the drilling assembly allows the preferred compliance or spring rate to be introduced to the bottom hole assembly to reduce the impact of damaging vibrations produced by the drilling process. The effective stiffness of the tool can be tailored by preferential activation and deactivation of the individual suppression modules to produce a spring rate that is neither too soft nor too stiff for the drilling conditions encountered.

When the suppression modules 300 are positioned in series, as in the suppression assembly 200 (see FIG. 2), the distal end 314 of the spindle 303 of a first suppression module 300*a* extends through the aperture in the top plate 323 of the first suppression module 300*a* and into an aperture in the bottom plate 301 of an adjacent suppression module 300*b*. The distal end 314 of the spindle 303 of the first suppression module 300*a* is in contact with, or adjacent to, the base portion 308 of the spindle 303 in the adjacent suppression module 300*b*. In turn, the distal end 314 of the spindle 303 in the adjacent suppression module 300*b* extends into the aperture in the bottom plate 301 of an additional adjacent suppression module 300*c*, and so on as with further adjacent modules, in the same manner described with respect to the first suppression module 300*a*. In one embodiment, the distal end 314 includes a decreased width and/or diameter as compared to the rest of the elongated portion 312. In another embodiment, a distal end bearing 315 (e.g., cylindrical bearing) is coupled to the distal end 314, the distal end bearing 315 being flush or substantially flush with the rest of the elongated portion 312. As the distal end 314 moves through the aperture in the top plate 323 and/or the bottom plate 301, the distal end bearing 315 reduces friction and/or facilitates sliding between the elongated portion 312 and the top plate 323 and/or the bottom plate 301.

The spindles 303 of the suppression modules 300 form a load path through the suppression assembly 200, with the individual suppression modules 300 acting in parallel to support a thrust through the suppression assembly 200. In one embodiment, the drill bit 125 directly or indirectly contacts the base portion 308 of the spindle 303 in the first suppression module 300*a*. When the drill bit 125 axially thrusts against the suppression assembly 200, it moves the spindles 303 of the first suppression module 300*a* and any adjacent suppression modules 300. The springs 307 of any activated suppression modules 300 absorb the thrust independent of the enclosures of each suppression module 300, supporting the thrust through the suppression assembly 200 and changing the compliance through the rest of the drillstring 120.

A total stiffness (e.g., spring rate) of the suppression assembly 200 is a sum of the individual stiffness values of the activated suppression modules 300. Although the spring 307 in each of the suppression modules 300 includes a prescribed stiffness, the total stiffness of the suppression assembly 200 is varied by activating and deactivating the individual suppression modules 300. The stiffness of the spring 307 may be the same in each of the suppression modules 300, or may differ between one or more of the suppression modules 300. For example, the stiffness of the spring 307 may differ by varying amounts between each of the suppression modules 300, may be stepped between suppression modules 300, may include a binary escalating sequence such that each successive suppression module 300 includes a stiffness that is half the stiffness of the suppression module 300 after it and twice the stiffness of the suppression module 300 before it, or a combination thereof.

By actuating combinations of springs 307 in the suppression modules 300 the stiffness may be changed between suppression modules 300 having similar springs 307. Activating and deactivating different combinations of suppression modules 300 provides different total stiffness values of the suppression assembly 200. For example, a suppression assembly 200 having three suppression modules with spring rates of 400,000 lbs/in, 200,000 lbs/in, and 100,000 lbs/in is capable of providing total stiffness values of 100,000 lbs/in, 200,000 lbs/in, 300,000 lbs/in (200,000+100,000), 400,000 lbs/in, 500,000 lbs/in (400,000+100,000), 600,000 lbs/in (400,000+200,000), and 700,000 lbs/in (400,000+200,000+100,000). As will be understood by one skilled in the art, these values are examples only, and are not necessarily representative of the spring rates or total stiffness values used during drilling.

Control features within and/or coupled to the drilling tool 112 are configured to activate and/or deactivate the individual suppression modules 300. The control features include, but are not limited to, a processor, one or more individual controllers, or a combination thereof. Each of the one or more individual controllers is coupled to one of the individual suppression modules 300. The processor provides commands to the one or more individual controllers, selectively activating or deactivating each of the individual suppression modules 300.

In one embodiment, the processor is coupled to an input device, such as a keypad and/or a touch screen positioned at the surface 107. The processor receives input provided to the input device at the surface 107, and provides commands to the one or more individual controllers to remotely activate and/or deactivate the individual suppression modules 300. In another embodiment, the drilling tool 112 includes one or more vibration sensors configured to measure vibration levels in the drillstring 120. The one or more vibration sensors are coupled to the processor (e.g., integral with, hard wired, wireless) and include, but are not limited to, an accelerometer, a linear variable differential transformer, or a combination thereof. The processor develops autonomous control commands in response to the vibration levels indicated by the vibration sensor(s), then provides the autonomous control commands to the individual controllers. The individual controllers receive the autonomous control commands and activate and/or deactivate the individual suppression modules 300 to vary the total stiffness of the suppression assembly 200. For example, in response to increased vibration, the control features may deactivate suppression modules 300 using the latching mechanism 321, rotating the activation mechanism 313 to the inactive position. Alternatively, in response to decreased vibration, the control features may activate additional suppression modules 300 by electrically heating the SMA actuator 317 to rotate the activation mechanism 313 and engage the spring 307. Any suitable combination of suppression modules 300 having the same or different springs 307, stiffness values, actuators 317, and/or activation mechanisms 313 may be used.

FIGS. 6-7 illustrate various embodiments of spacers and springs according to embodiments of the disclosure. The various embodiments of spacers and springs can be used to allow a variety of spring types and lengths to be used within a common suppression module.

FIG. 6 is an isolation view of a spindle having a smaller helical spring 307 and a larger spacer 305, according to an embodiment of the disclosure. The smaller helical spring 307 and larger spacer 305 may be used to fit a spring with a shorter overall length within the suppression module.

FIG. 7 is an isolation view of a spindle having a larger helical spring and a smaller spacer, according to an embodiment of the disclosure. The larger helical spring 307 and smaller spacer 305 may be used to accurately shim an arbitrary overall spring length to adjust it to the suppression module.

FIG. 8 is an isolation view of a spindle having a Belleville spring 801, according to an embodiment of the disclosure. The Belleville spring 801 may be used to provide a preferred spring rate or other spring property that cannot be achieved with a helical spring, such as a progressive or non-linear spring rate as may be achieved with Belleville springs. In this embodiment, the larger spacer 305 is used to shim the overall Belleville spring stack height to fit the compression module.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A suppression module, comprising:

a spindle having a first end and a second end;

an ear plate slideably disposed between the first end and the second end;

a spring positioned between the ear plate and the first end; and an activation mechanism coaxially disposed around the second end of the spindle;

wherein the activation mechanism comprises an actuator arranged and disposed to rotate a spline mechanism into and out of engagement with the ear plate, thereby activating the spring or deactivating the spring, respectively.

2. The suppression module of claim 1, wherein the actuator comprises:

a shape memory alloy that rotates the spline mechanism into engagement with the ear plate in response to thermal activation; and a bias spring that rotates the spline mechanism out of engagement with the ear plate when the shape memory alloy is not thermally activated.

3. The suppression module of claim 1, further comprising a controller arranged and disposed to operate the actuator.

4. The suppression module of claim 1, further comprising:

a latch mechanism positioned over the spline mechanism; and a bearing positioned between the latch mechanism and the actuator.

5. The suppression module of claim 1, wherein the spring is selected from the group consisting of a helical spring, a Belleville spring, and combinations thereof.

6. The suppression module of claim 1, wherein the suppression module is positioned within a drillstring.

7. A suppression assembly, comprising:

at least two suppression modules, each suppression module comprising:

a spindle having a first end and a second end;

an ear plate slideably disposed between the first end and the second end;

a spring positioned between the ear plate and the first end; and an activation mechanism coaxially disposed around the second end of the spindle; and a processor;

wherein the activation mechanism engages the ear plate, activating the spring, or disengages the ear plate, deactivating the spring; and wherein the suppression modules are activated or deactivated by the processor, each of the suppression modules being activated or deactivated independent of the other suppression modules.

8. The suppression assembly of claim 7, wherein each of the suppression modules further comprises an actuator, the actuator arranged and disposed to move the activation mechanism between an active position and an inactive position.

9. The suppression assembly of claim 8, wherein the activation mechanism further comprises a spline mechanism, and the actuator further comprises a shape memory alloy, the shape memory alloy rotating the spline mechanism between the active position and the inactive position.

10. The suppression assembly of claim 7, further comprising:

at least one vibration sensor arranged and disposed to determine vibration in the drilling tool; and at least one controller coupled to each of the at least two suppression modules;

wherein the processor generates autonomous control commands in response to the vibration indicated by the at least one vibration sensor; and wherein the at least one controller receives the autonomous control commands generated by the processor, and independently activates or deactivates the activation mechanism of each of the at least two suppression modules in response to the autonomous control commands.

11. The suppression assembly of claim 7, wherein each of the suppression modules comprises a prescribed stiffness.

12. The suppression assembly of claim 11, wherein activating or deactivating each of the suppression modules varies a stiffness of the suppression assembly.

13. The suppression assembly of claim 11, wherein the prescribed stiffness of at least one of the suppression modules differs from the prescribed stiffness of at least one other suppression module.

14. The suppression assembly of claim 7, wherein the suppression assembly is positioned in a bottom hole assembly of a drillstring.

15. The suppression assembly of claim 7, wherein the suppression assembly forms a shock-sub in a drillstring.

16. The suppression assembly of claim 7, further comprising between two and five suppression modules.

* * * * *